US005588290A

United States Patent [19]

Cobb

[11] Patent Number: 5,588,290

[45] Date of Patent: Dec. 31, 1996

[54] REEL-TO-REEL PIPE WRAP MACHINE

[76] Inventor: Robert E. Cobb, Rte. 8, Box 267-B, Claremore, Okla. 74017

[21] Appl. No.: 424,735

[22] Filed: Apr. 17, 1995

[51] Int. Cl.[6] ..... D02G 3/36

[52] U.S. Cl. ..... 57/3; 57/10; 57/11; 57/18; 57/19; 242/441.2

[58] Field of Search ..... 242/7.22, 7.21; 57/3, 10, 11, 12, 13, 14, 15, 16, 17, 18, 19

[56] References Cited

U.S. PATENT DOCUMENTS

| | | | |
|---|---|---|---|
| 2,174,754 | 10/1939 | Miller | 242/7.22 |
| 3,128,216 | 4/1964 | Reed | 242/7.22 |
| 3,789,594 | 2/1974 | Rees | 242/7.22 |
| 3,851,831 | 12/1974 | Steiner et al. | 242/7.22 |
| 4,346,550 | 8/1982 | Ferree | 57/3 |
| 4,463,547 | 8/1984 | Young | 57/10 |
| 4,663,928 | 5/1987 | Delobel et al. | 57/3 |
| 4,856,720 | 8/1989 | Deregibus | 242/7.22 |
| 5,346,149 | 9/1994 | Cobb | 242/7.22 |

*Primary Examiner*—William Stryjewski
*Attorney, Agent, or Firm*—Frank J. Catalano; Scott R. Zingerman

[57] ABSTRACT

A machine wraps pipe as it travels along a substantially linear path between a feeder reel from which the pipe is unwound to a take up reel onto which the pipe is rewound. A pipe wrap assembly for wrapping one or more layers of tape about the pipe is rotatably mounted on a carriage. A mechanism mounted on the carriage and engaged with the pipe drives the carriage along the pipe as the pipe travels from reel-to-reel. As the carriage is driven along the pipe, the tape is spirally applied to the pipe by the pipe wrap assembly. The carriage is supported for lateral horizontal movement in response to variation in the unwind and rewind points on the feeder and take-up reels. The carriage is also supported for longitudinal horizontal movement in response to changes in the rate of travel of the pipe relative to the rate of travel of the carriage. A drive control mechanism permits variation in the rate of travel of the carriage to compensate for variations in the rate of travel of the pipe between the reels to maintain the carriage in generally constant position as the pipe travels between the feeder and take up reels. The controller may be manually operated in response to visual observations by the operator or may be automatically operated in response to sensor or computer data to determine the longitudinal position of the carriage.

10 Claims, 4 Drawing Sheets

REEL-TO-REEL PIPE WRAP MACHINE

BACKGROUND OF THE INVENTION

This invention relates generally to pipe wrap machines and more particularly concerns machines for wrapping pipe stored on a reel.

In typical installations of underground pipe or tubing systems, the present practice involves either off-site or on-site procedures to wrap the pipe with one or more layers of protective material. In the off-site procedure, the pipe is wrapped in straight lengths of twenty, forty or sixty feet before shipment to the site. This is generally accomplished by moving straight lengths of pipe through a fixed position pipe wrap machine. After the wrapped pipe is delivered to the site, the pipe joints are welded and the welded joints are wrapped to complete wrapping of the entire length of pipe. The separate joint welds and wraps are at best inefficient and at worst result in inconsistent and welding along the total pipe length. In the on-site application, the pipe is laid and welded and then wrapped by a pipe wrap machine which travels along the pipe. The manipulation and operation of the pipe wrap machine along thousands of feet of pipe under construction site conditions is a difficult and time consuming task.

Since, for example, two inch outer diameter pipe is wound at approximately 20,000 feet per reel and 3½ inch outer diameter pipe at 6,000 per reel, use of prewrapped reels of pipe could greatly simplify the pipe laying task. But, while it is clearly desirable to prewrap pipe on a reel, until now no machine has been devised which can accomplish the task. The underlying problem has been that, as pipe is wound onto or unwound from a reel, the diameter of the coil and the alignment of the pipe are constantly varying. Presently known pipe wrap machines are unable to compensate for the resulting variations in speed of pipe travel, much less the combined variation of speed and alignment. For applications in which prewrapped, reeled pipe is required, the pipe is presently wrapped by hand as it is unwound from a feeder reel and rewound on a take-up reel. However, hand wrapping is slow and tedious, typically involving a two feet per minute wrap rate. In most applications, the pipe is wrapped with at least two different materials which, in the hand wrapping process, requires two different wrapping steps. The total time for wrapping a reel of pipe using the hand method is, therefore, generally prohibitive.

It is, therefore, an object of this invention to provide a machine which automatically wraps pipe in reel-to-reel fashion. Similarly, it is an object of this invention to provide a machine which facilitates simultaneous multiple wrapping of pipe in reel-to-reel fashion.

SUMMARY OF THE INVENTION

In accordance with the invention a machine is provided for wrapping pipe as it travels along a substantially linear path between a feeder reel from which the pipe is unwound to a take up reel onto which the pipe is rewound. A pipe wrap assembly for wrapping one or more layers of tape about a pipe is rotatably mounted on a carriage. A mechanism mounted on the carriage and engaged with the pipe drives the carriage along the pipe as the pipe travels from reel-to-reel along the substantially linear path. As the carriage is driven along the pipe, the tape is spirally applied to the pipe by the pipe wrap assembly. The carriage is supported for lateral horizontal movement in response to shifts in the substantially linear path which result as the unwind and rewind points on the feeder and take-up reels shift horizontally. The carriage is also supported for longitudinal horizontal movement in response to changes in the rate of travel of the pipe relative to the rate of travel of the carriage. The carriage support may be a platform on rolling casters, an overhead crane having X–Y mobility or any other suitable support permitting horizontal movement of the carriage. A drive control mechanism permits variation in the rate of travel of the carriage to compensate for variations in the rate of travel of the pipe between the reels to maintain the carriage in generally constant position between the feeder and take up reels as the pipe travels along the substantially linear path. The controller may be manually operated in response to visual observations by the operator or may be automatically operated in response to sensor or computer data to determine the longitudinal position of the carriage. A manual control reel-to-reel pipe wrap machine applies multiple wraps of tape at a rate of approximately 11 feet per minute.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
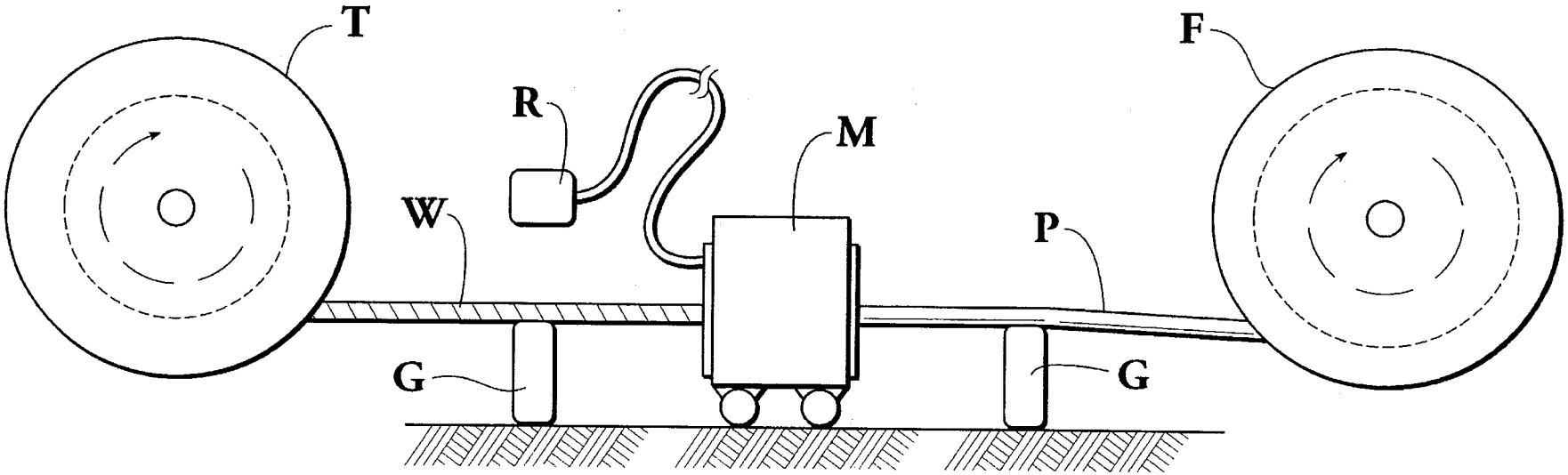
FIG. 1 is a side elevation view of a pipe wrap machine mounted on a pipe traveling between feeder and take-up reels.
Figure 2:
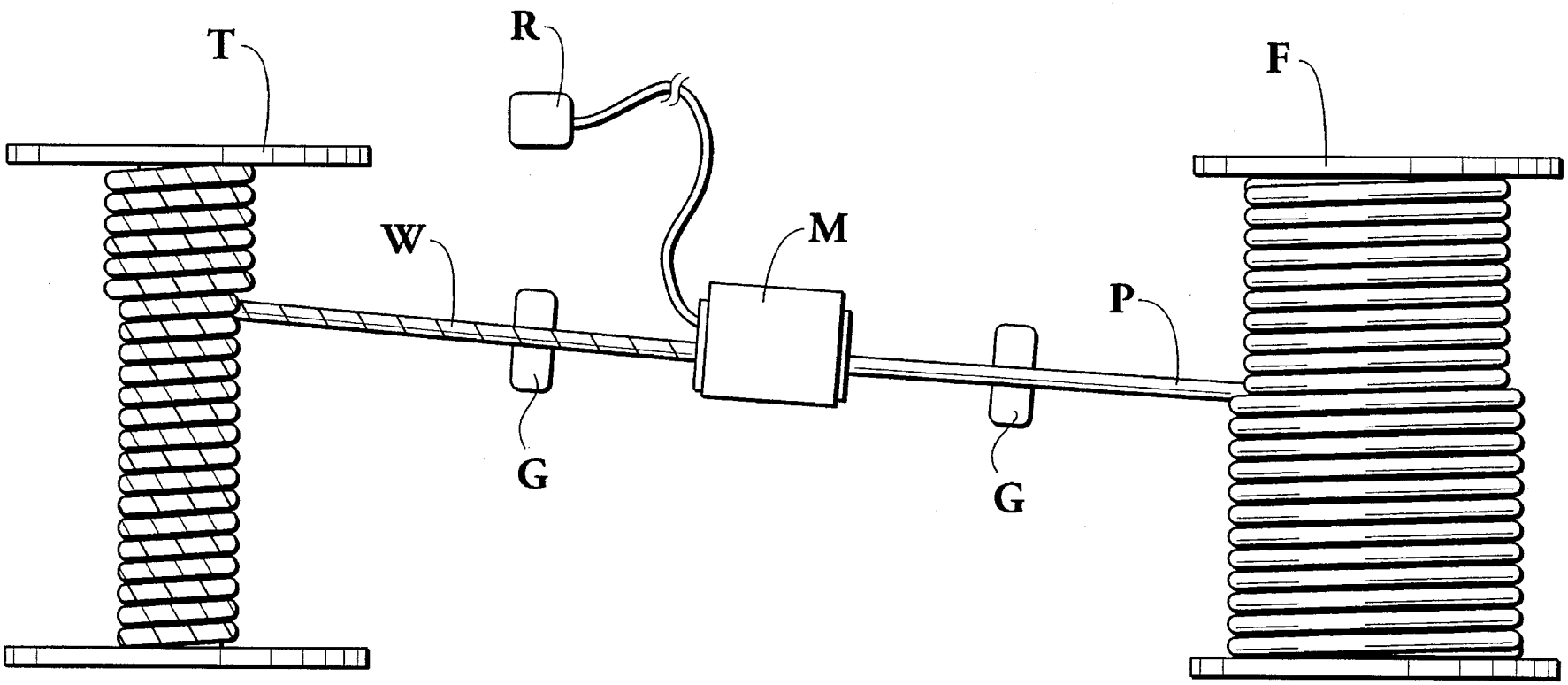
FIG. 2 is a top plan view of the pipe wrap machine mounted on a pipe traveling between feeder and take-up reels.

Turning first to FIGS. 1 and 2, pipe P is distributed from a feeder reel F through an automatic pipe wrap machine M from which the wrapped pipe W is collected for storage on a take-up reel T. In a typical arrangement, the take-up reel T will be rotatively driven to draw pipe from the feeder reel F and the feeder reel F will have a brake mechanism for maintaining the pipe under tension between the two reels T and F. It will be readily noted that as the wrapped pipe W is collected on the take-up reel T the diameter of the coils on the take-up reel increases, therefore increasing the speed of the pipe as it travels through the pipe wrap machine M. It will also be noted that the points of dispensation and collection from and to the feeder reel F and take-up reel T vary along the axial length of the reel so that the beginning and end points of the travel path of the pipe change throughout the process. A manually operated remote control unit R permits an operator to control the relative speed between the pipe and the machine M to maintain the position of the machine M between the feeder reel F and the take-up reel T substantially constant. Movable guide posts G control the height of the pipe and assist in maintaining as constant a travel path as possible.

Figure 3:
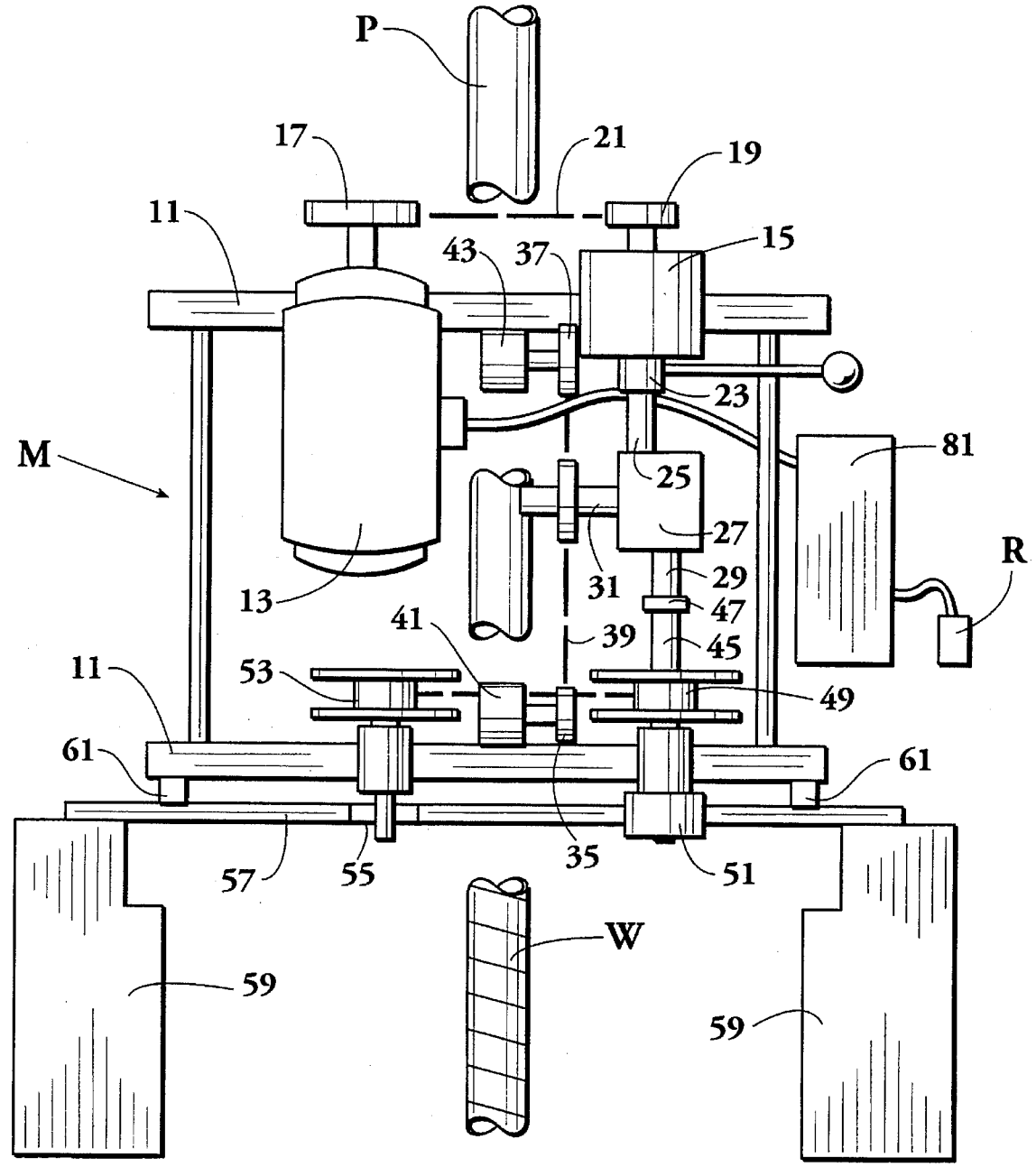
FIG. 3 is a top plan view illustrating the pipe wrap machine of FIGS. 1 and 2.
Figure 4:
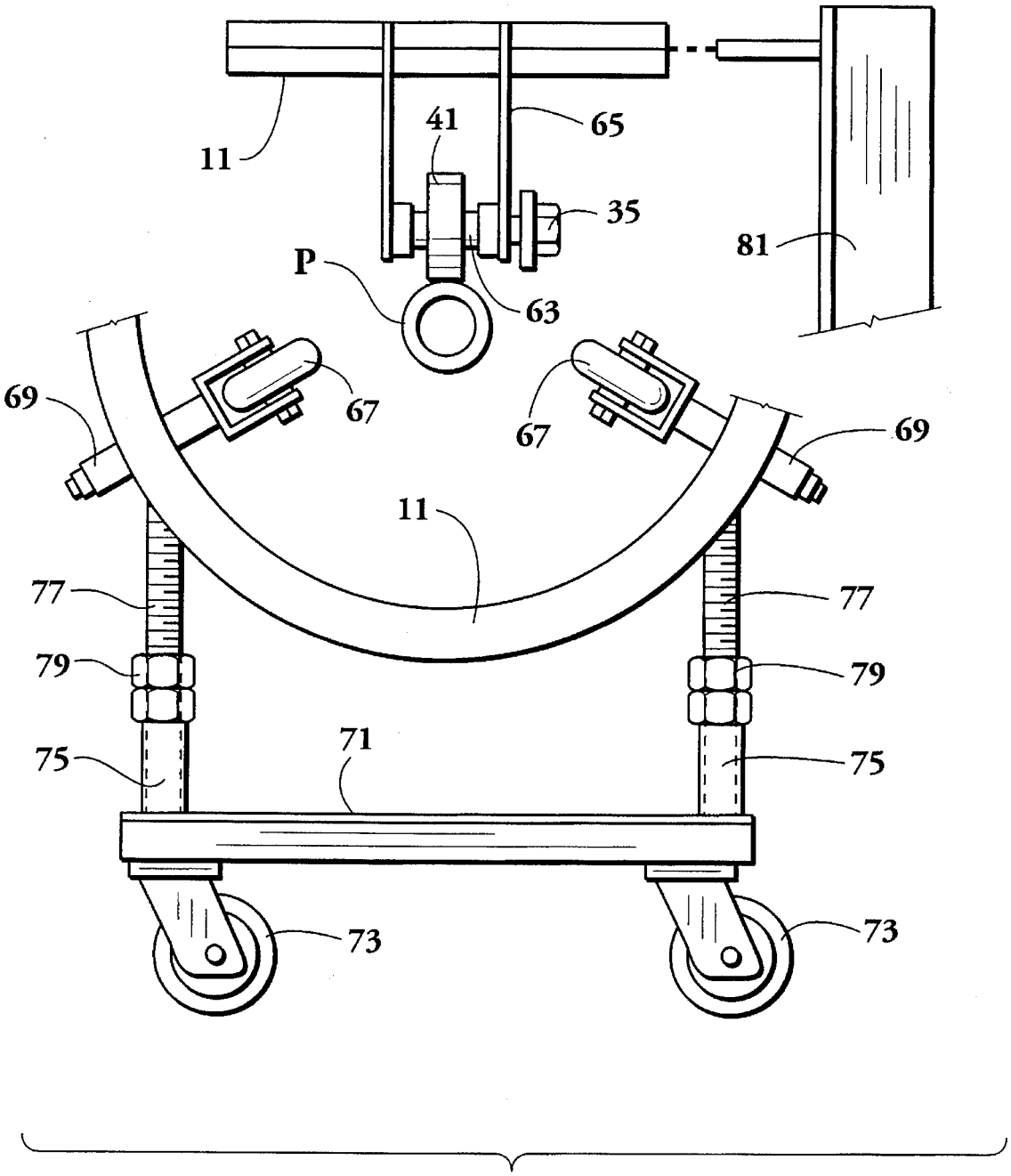
FIG. 4 is a front elevation view illustrating the pipe wrap machine of FIGS. 1 and 2.

Turning now to FIGS. 3 and 4, the pipe wrap machine is illustrated in greater detail. As shown, the machine M consists of a multiplicity of components mounted on a frame or carriage 11 having circular front and back members spaced by longitudinal stiffening members. The drive motor 13 is bracketed on one side of the carriage 11 proximate the rear member thereof. A transmission 15 is also bracketed to the carriage 11 on the opposite side of the rear member and the shafts of the motor 13 and the transmission 15 are connected at respective drive motor and transmission sprockets 17 and 19 by a drive chain 21. The transmission 15 includes a clutch 23 having forward and reverse gears. An in-line gear shaft 25 connects the transmission 15 to a speed reducer 27 which is in turn connected to an in-line secondary gear shaft 29 and a perpendicular main drive shaft 31. A main drive sprocket 33 on the shaft 31 is connected to front and rear drive wheel sprockets 35 and 37 by a drive sprocket chain 39. The front and rear drive wheel sprockets 35 and 37 are in turn shafted to the front and rear drive wheels 41 and 43 which will rest on and drive the carriage along the pipe P. The secondary gear shaft 29 is connected to an in-line tape wrap shaft 45 such as by chain connected sprockets 47 as shown. The tape wrap shaft 45 drives a mechanically operated variable speed pulley 49 having a manually adjustable speed knob 51. The variable speed pulley 49 is belted to a spring loaded pulley 53. The spring loaded pulley 53 is in turn shafted to a small tape wrap drive sprocket 55 which in turn is engaged with the wide diameter tape wrap drive sprocket 57 on which one or more tape dispenser assemblies 59 is mounted for rotation about the pipe P. The wide diameter sprocket 57 rotates about the front member of the carriage 11 on bearings 61.

As can best be seen in FIG. 4, the front and rear drive wheels 41 and 43 are bracketed to the carriage frame 11 so that, when the drive wheels 41 and 43 are mounted on the pipe P, the pipe P will be centered on the circular members of the carriage 11. The shaft 63 is adjustably positionable within the bracket 65 so that the pipe P will be centered on the carriage 11 regardless of the diameter of the pipe P. The carriage 11 also has, preferably at 120 degree intervals from the vertical, a pair of guide wheels 67 yoked to the frame 11 on threaded shafts 69 so that the wheels 67 can be extended to the outer wall of the pipe P to maintain the balance of the carriage 11 on the pipe P. The carriage 11 is mounted on a platform 71 which is in turn mounted on casters 73 having vertical tubes 75 extending upwardly from approximately each of its corners. Threaded rods 77 seated in the tubes 75 are fixed to the carriage 11 with pairs of lock nuts 79 threaded onto the rods 77. By appropriately positioning the lock nuts 79 on the rods 77, the height of the carriage 11 above ground is established.

Returning to FIG. 3, the drive motor 13 is seen to be electrically connected to a control panel 81 mounted on the carriage 11 and the control panel 81 is further electrically connected to the remote control variable switch R. The rate of speed of the drive wheels 41 and 43 in relation to the pipe P and the amount of overlap in the tape wrap is a function of the speed reducer 27 which determines the speed of the drive wheels 41 and 43 and also the speed of the in-line tape wrap shaft 45. Manual adjustment of the mechanically operated variable speed pulley 49 sets the speed of the spring loaded pulley 53 to set the rotation of the wide diameter tape wrap drive sprocket 57 so that the wide diameter sprocket 57 completes one rotation for a selected number of inches of travel of the drive wheels 41 and 43 along the pipe P. The control panel 81 permits selection of the basic speed of the drive motor 13 while the remote R permits the operator to control or vary the speed of the drive motor 13 within a range sufficient to maintain the machine M in substantially constant position between the take-up reel T and feeder reel F even as the speed of the pipe P passing through the machine M varies with the changing diameter of the take-up reel pipe coils. Since the carriage is mounted on the casters 73, the carriage 11 is free to move throughout a 360 degree range in the horizontal plane so the machine M is free to compensate for changes in the speed of travel of the pipe P as well as angular and positional deviations along the path of travel between the feed reel F and the take up reel T.

In operation, the relative speeds of travel of the drive wheels 41 and 43 and of the wide diameter sprocket 57 are determined. The drive wheels 41 and 43 and the guide wheels 67 are positioned to properly align the pipe P within the machine M. The lock nuts 79 are positioned to locate the carriage at its desired height above ground. The pipe P is threaded through the machine M from the feeder reel F to the take-up reel T. The position of the clutch 23 is selected in accordance with the direction in which the pipe P has been fed through the machine M. The winding of the take-up reel T is initiated. The drive motor 13 is energized and the wrapping process is begun. If the position of the machine M varies sufficiently within the determination of either the manual operator or automatic sensing or computing devices, the speed of the drive motor 13 is varied accordingly by use of the remote R to bring the machine M to the desired position between the reels F and T.

While the path of travel of the pipe P is herein referred to as being substantially linear, it should be understood that that term is intended to include all of the possibilities of angular position of the path as determined by the dispensation and collection points of the coils from and onto the feeder reel F and the take-up reel T. By changing the position of the clutch 23, the drive wheels 41 and 43 and the wide diameter sprocket 57 can be driven in either a forward or reverse direction.

In a preferred embodiment of the machine M, the drive motor 13 is an Elektrim electric motor (5 hp), the control panel 81 is a Lancer GPD 502 (7.5 hp) drive control panel, the transmission is a Snow-Nabstedt Model 5101B, the speed reducer is a Ramsey Model S-7 and the pulleys 49 and 53 are Lovejoy Model HM-3 and Lovejoy 9203 Model 11903.

Many options in the above components and linkage arrangements will be known to those skilled in the art. The system is not necessarily electrically driven. Furthermore, while the invention has been disclosed and described in relation to a manually operated remote control for varying the speed of the drive wheels 41 and 43 in response to visual observation of the position of the machine M between the feeder reel F and the take-up reel T, any type of sensor or computer device capable of determining the position of the machine M between the feeder reel F and the take-up reel T could be used in lieu thereof or in combination therewith.

Thus, it is apparent that there has been provided, in accordance with the invention, a reel-to-reel pipe wrap machine that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A pipe wrapping system comprising:

a feeder reel for dispensing pipe coiled thereon;

a take-up reel for collecting the dispensed pipe in coils thereabout;

means independently disposed between said feeder and take-up reels and engaged with the pipe for travel along said pipe for spirally wrapping tape about the pipe; and means for varying a rate of travel of said wrapping means in relation to the pipe to maintain said wrapping means between said feeder and take-up reels as a rate of travel of the pipe varies.

2. A machine for wrapping a pipe as it travels along a substantially linear path between a feeder reel from which the pipe is unwound to a take-up reel onto which the pipe is rewound comprising:

a free-standing carriage;

means rotatively mounted on said carriage for wrapping tape about the pipe;

means mounted on said carriage and engaged with the pipe for driving said carriage along the pipe and causing the tape to be spirally applied to the pipe by said wrapping means as the pipe travels along the substantially linear path;

means fixed to and supporting said carriage for lateral horizontal movement in response to shifts of the substantially linear path and for longitudinal horizontal movement in response to changes in the rate of travel of the pipe as the pipe is unwound and rewound; and means for varying said rate of travel of said carriage along the pipe to maintain said carriage between the feeder and take-up reels as the rate of travel of the pipe varies.

3. A machine according to claim 2, said driving means being positionally adjustable to permit centering of rotation of said wrapping means about various diameter pipes.

4. A machine according to claim 3, said driving means further comprising means for selecting a rate of rotation of said wrapping means in relation to a rate of said travel of said carriage along the pipe.

5. A machine according to claim 2 further comprising means mounted on said carriage and contacting the pipe for maintaining said drive means on the pipe during travel therealong.

6. A machine for wrapping a pipe as it travels along a substantially linear path between a feeder reel from which the pipe is unwound to a take-up reel onto which the pipe is rewound comprising:

a free-standing carriage;

means rotatively mounted on said carriage for wrapping tape about the pipe;

means mounted on said carriage and engaged with the pipe for driving said carriage along the pipe and causing the tape to be spirally applied to the pipe by said wrapping means as the pipe travels along the substantially linear path;

means fixed to and supporting said carriage for lateral horizontal movement in response to shifts of the substantially linear path and for longitudinal horizontal movement in response to changes in the rate of travel of the pipe as the pipe is unwound and rewound, said supporting means being adjustable to vary a height of said carriage; and means for varying said rate of travel of said carriage along the pipe to maintain said carriage between the feeder and take-up reels as the rate of travel of the pipe varies.

7. A machine for wrapping a pipe as it travels along a substantially linear path between a feeder reel from which the pipe is unwound to a take-up reel onto which the pipe is rewound comprising:

a carriage;

means mounted on said carriage and engaged with the pipe for rotation on the pipe for transporting said carriage along the pipe as the pipe travels along the substantially linear path;

means rotatively mounted on said carriage for spirally wrapping tape about the pipe as the pipe travels along the substantially linear path;

means mounted on said carriage for driving a main shaft at a predetermined rate of rotation;

means coupled between said main shaft and said transporting means for driving said transporting means at a first rate of rotation;

means coupled between said main shaft and said wrapping means for driving said wrapping means at a second rate of rotation;

means supporting said carriage for lateral horizontal movement in response to shifts of the substantially linear path and for longitudinal horizontal movement in response to changes in the rate of travel of the pipe as the pipe is unwound and rewound; and means for adjusting said predetermined rate of rotation of said driving means to vary said first rate of rotation to maintain said carriage between the feeder and take-up reels as the rate of travel of the pipe varies.

8. A machine according to claim 7 further comprising means for adjusting said wrapping means coupling means to vary said second rate of rotation without varying said first rate of rotation.

9. A machine according to claim 7 further comprising means coupled between said main shaft and said driving means for reversing a direction of rotation of said main shaft.

10. A machine according to claim 9 further comprising means coupled between said reversing means and said main shaft for reducing a rate of rotation of said main shaft in relation to said driving means.

* * * * *